United States Patent [19]

MacMullin

[11] 4,048,046

[45] Sept. 13, 1977

[54] ELECTROLYTIC CELL DESIGN

[75] Inventor: Robert Burns MacMullin, Lewiston, N.Y.

[73] Assignee: The B. F. Goodrich Company, Akron, Ohio

[21] Appl. No.: 696,583

[22] Filed: June 16, 1976

[51] Int. Cl.[2] ..... C25B 1/16; C25B 1/26

[52] U.S. Cl. ..... 204/266; 204/270; 204/289

[58] Field of Search ..... 204/234, 252, 237, 257, 204/258, 263, 266, 269, 275, 278, 280, 288, 289

[56] References Cited

U.S. PATENT DOCUMENTS

| | | | |
|---|---|---|---|
| 1,907,812 | 5/1933 | Honsberg | 204/252 |
| 2,762,765 | 9/1956 | Kircher | 204/289 X |
| 2,868,712 | 1/1959 | Deprez | 204/288 |
| 3,305,472 | 2/1967 | Oldershaw et al. | 204/237 X |
| 3,674,676 | 7/1972 | Fogelman | 204/288 X |
| 3,855,104 | 12/1974 | Messner | 204/258 X |

*Primary Examiner*—Arthur C. Prescott
*Attorney, Agent, or Firm*—Harry F. Pepper, Jr.

[57] ABSTRACT

An electrolytic cell comprises two vertically extending, adjacent electrodes. The space between the electrodes is an electrolysis zone. The electrolysis zone has upper, middle and lower portions. The cell further comprises upper and lower plenum chambers above and below the upper and lower portions of the electrolysis zone, respectively. The cell has a channel which at least partially defines a passageway. The channel may be in an electrode, a cell wall, or in both. The passageway extends between the upper and lower plenum chambers but is inaccessible from the middle portion of the electrolysis zone. The cell may have a plurality of passageways. The improved design is particularly applicable to electrolytic processes in which gases are evolved at either or both of the electrodes, and in which the electrolytes and gaseous products are separated by a diaphragm or ion exchange membrane.

12 Claims, 4 Drawing Figures

ELECTROLYTIC CELL DESIGN

BACKGROUND OF THE INVENTION

This invention relates to electrolytic systems and more particularly to electrolytic cell design.

Many commercially important products are produced by electrolysis. For example, in the electrolysis of sodium chloride brine, chlorine gas is produced at the anode and caustic soda and hydrogen gas are produced at the cathode. In the electrolysis of water, oxygen gas is evolved at the anode while hydrogen gas is evolved at the cathode. In the refining of nickel, impure nickel is dissolved at the anode and pure nickel is deposited on the cathode. In electroorganic synthesis, organic compounds may be oxidized as in the Kolbe reaction, or reduced as in the hydro-dimerization of acrylonitrile to produce adiponitrile.

Electrolytic processes involve the forcing of a direct current through a suitable electrolyte between an anode and a cathode which are immersed in the electrolyte. The devices used to carry out such processes are known as electrolytic cells, the design of which must be adapted to the particular products being produced.

An electrolyte separator such as a diaphragm or membrane may be required in an electrolytic cell if the anolyte is necessarily of a different composition than the catholyte or if the anode and cathode products can mix. If the anode product can react with the cathode product, a separator can also prevent explosions.

Electrolytic cells which are adapted to evolve a product in the form of a gas must permit efficient removal of the gas from the electrolysis zone to prevent gas polarization. Therefore, in gas evolving cells, the electrodes are generally vertical.

In spite of the enormous variety of cell designs capital cost and unit energy consumption are factors that are considered in all cells. Low unit energy consumption, which results from a low cell voltage and a high current yield, or selectivity, is especially critical as the cost of power continues to increase. It is well known that the current efficiency of an electrolytic cell depends upon many factors, such as the nature of the electrodes, the nature and concentration of the electrolytes, and to some extent the current density. Power losses can result from cell overvoltages, as for example the excess voltage required to drive the anode reaction and the cathode reaction. These overvoltages depend upon the current density on the anode and cathode respectively, the temperature, and to some extent the concentrations of the electrolytes and the velocities of the electrolytes flowing over the electrodes.

Further power losses are the result of ohmic losses in the media between anode and cathode, as for example the $IR_a$ drop in the anolyte between anode and separator, the $IR_c$ drop in the catholyte between cathode and separator, and the $IR_d$ drop in the separator itself. The individual resistances $R_a$, $R_c$, $R_d$, etc., depend partially upon the corresponding resistivities of the medium under operating conditions. It is obviously desirable to reduce the resistivity of the electrolyte to decrease power losses.

The volume of gas evolved at the electrode is proportional to the current supplied to the electrode. The accumulation of gas in the gap between electrode and separator, i.e., the electrolysis zone, increases the electrolyte resistance according to the equation:

$$(R/R_o = [1-\epsilon]^{-3/2}$$

where $R$ is the electrolyte resistance with gas bubbles present, $R_o$ is the electrolyte resistance with no gas bubbles present, and $\epsilon$ is the volume fraction of gas present in the electrolyte. This increase in resistivity occurs because of the difficulty of electromigration of ions through a nonconductive gaseous matter.

In the several types of cells involving electrolysis of aqueous solutions, product gas bubbles rise through the liquid electrolyte carrying with them a liquid boundary layer. The bubbles burst after they emerge from the electrolyte, thereby releasing the product gas for collection. As the bubbles burst, the liquid boundary layer is released. This liquid then moves downward through the electrolysis zone to replace the liquid being brought up to the top of the cell on the boundary layers of other bubbles. The net result is a steady downward flow of liquid which opposes the upward movement of the bubbles, thereby reducing the velocity of the rising product bubbles. The concentration of bubbles present in the electrolyte therefore increases, increasing the electrolyte resistivity as previously discussed.

This increase in electrolyte resistivity can be minimized by enabling rapid escape of the bubbles from the electrolysis zone. One method of effecting this rapid escape is by an external electrolyte circulation system utilizing circulation pumps. These pumps can circulate electrolyte, which carries the gas product bubbles, upward through the electrolysis zone. However, the cost of the power to run the pump may cancel any power savings achieved by the lower electrolyte resistivity. Furthermore, higher construction and capital costs are required with an external circulation system, as for example for large external piping, additional floor space, large traps for separating product gases from electrolyte, and, in bipolar electrolyzers, for large currrent breakers to prevent current bypassing around the cells.

Other attempts have been made to enable a rapid escape of product bubbles. The electrodes of some electrolytic cells have vertically grooved surfaces with the ridges between the grooves of opposing electrodes used to support a flexible separator. With this design, it was attempted to provide a region for the evolved product bubbles to rise through the electrolysis zone without opposing the downward flow of electrolyte. In a cell of this type there is some tendency for the product gases to rise through the electrolyte near the electrolyte separator at the front of the grooves, and for the electrolyte to flow downward near the back of the grooves. However, the downward flow of electrolyte is counter to the rising product bubbles and any steady downward electrolyte flow is soon interrupted.

SUMMARY OF THE INVENTION

It is an object of the present invention to provide an electrolytic cell with increased power efficiency.

It is a further object of the present invention to provide an electrolytic cell having improved means for electrolyte recirculation.

These and other objects of the present invention which will become evident by the following detailed description are achieved by an electrolytic cell having first and second vertically extending adjacent electrodes. An electrolysis zone having upper, middle and lower portions extends between the electrodes. The cell further comprises upper and lower plenum chambers above and below the upper and lower portions of the electrolysis zone, respectively. The cell includes a channel which at least partially defines a passageway. The channel may be in an electrode, a cell wall, or in both. The passageway extends between the upper and lower plenum chambers but is inaccessible from the middle portion of the electrolysis zone.

DETAILED DESCRIPTION OF A PRESENTLY PREFERRED EMBODIMENT

Figure 1:
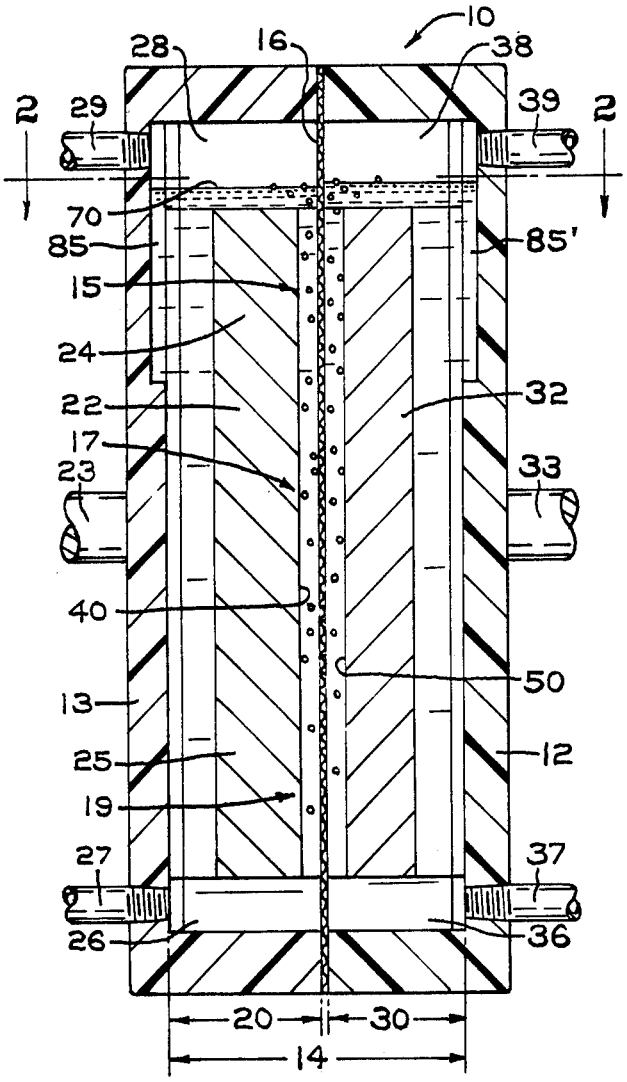
FIG. 1 is a cross-sectional side view of an electrolytic cell of the present invention.

FIG. 1 shows a single, separator type electrolytic cell in which gases evolve from each electrode during electrolysis. Although this invention is not limited to the production of any particular electrolysis products, the presently preferred embodiment will be described for producing chlorine gas from an alkali metal chloride brine at the anode, and hydrogen gas plus a salt or a hydroxide of the aforesaid alkali metal at the cathode.

The cell 10 has cell wall portions, 12 and 13, which are sealed together by suitable means (not shown) to define an electrolysis chamber 14. The cell wall portions are of polypropylene but may be of any other suitable material well known in the art.

Electrolysis chamber 14 is vertically divided into an anolyte compartment 20 and a catholyte compartment 30 by an electrolyte separator 16. The separator is clamped between cell wall portions 12 and 13. The anolyte is an aqueous solution of an alkali metal chloride, typically KCl. The catholyte is an aqueous solution of hydroxide, or a salt other than the chloride, of the same alkali metal, typically KOH or $KH_2PO_4$. In the present embodiment, the separator 16 is a cation exchange membrane which prevents intermingling of anolyte and catholyte while being selectively permeable to the transport of alkali metal inos from anolyte to catholyte. The separator 16 is generally flat in this preferred embodiment. It should, however, be noted that the type of separator used and the geometric configuration of the separator are not critical to this invention. For example, in HCl and water electrolyzers, the separator may be a permeable diaphragm.

A vertically extending anode 22 is positioned in the anolyte compartment 20 adjacent the electrolyte separator 16. A vertically extending cathode 32 is similarly positioned in the catholyte portion 30. The electrodes 22 and 32 have opposing surfaces 40 and 50, respectively. The region between the opposing surfaces 40 and 50 forms an electrolysis zone 18 (see FIG.2). Although the surfaces 40 and 50 are essentially flat in this embodiment, their geometry is not critical to this invention.

The electrodes 22 and 32 are comprised substantially of graphite, but other electrode materials for either the anode 22 or the cathode 32 may be utilized within the scope of this invention. For catholytes containing phosphate, graphite is the preferred material for the cathode 32. Electrodes 22 and 32 each have a direct electrical connection to a source of direct current through current collectors 23 and 33, which may be of an impervious graphite or other suitable material. It should be understood that although FIG. 1 represents a single cell, this invention is particularly applicable to multi-chambered electrolyzers having bipolar electrodes. It should, therefore, be noted that the terms "anode" and "cathode" in this specification and in the appended claims may refer, not only to unipolar electrodes such as 22 and 32, but also to those portions of a bipolar electrode that act as an anode or a cathode. In a multiple cell electrolyzer, containing intermediate cells with bipolar electrodes, only the end half cells are connected to the source of direct current, as will be shown in FIG. 4.

Below the anode 22 in the anolyte compartment 20 is a plenum chamber 26 which serves to evenly distribute incoming anolyte over the anode. A conduit 27 extending through the cell wall portion 13 connects the anolyte plenum with a source of fresh anolyte (not shown).

Similarly, below the cathode 32 in the catholyte compartment 30 is a plenum chamber 36 which evenly distributes incoming catholyte over the cathode. The conduit 37 extending through cell wall portion 12 connects the catholyte plenum with a source of fresh catholyte (not shown).

Above the anode 22 is an effluent plenum 28 which evenly collects spent anolyte and chlorine gas evolved on the anode. The anode effluents pass out of the cell through conduit 29 to a trap (not shown) that separates the gas from the liquid in the effluent.

Similarly, above the cathode 32 is an effluent plenum 38 to evenly collect fortified catholyte and hydrogen gas evolved on the cathode. The cathode effluents pass out of the cell through conduit 39 to a trap (not shown) that separates the gas from the liquid in the effluent.

It is to be understood that effluent anolyte, fortified with fresh alkali halide (KCl), may be circulated back to the cell at a rate sufficient to minimize $Cl_2$ gas polarization in the anolyte portion of the electrolysis zone 18. Similarly, a portion of the effluent catholyte may be circulated back to the cell at a rate sufficient to minimize $H_2$ gas polarization in the catholyte portion of the electrolysis zone 18.

Figure 2:
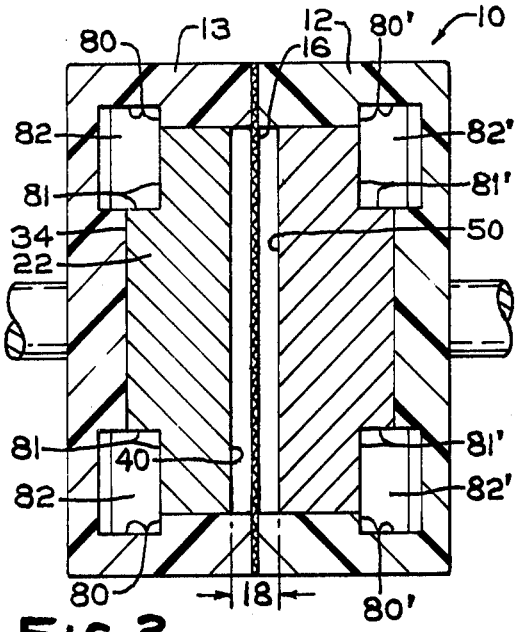
FIG. 2 is a top view of the electrolytic cell taken along line 2—2 of FIG. 1.

As can be seen in FIG. 2, the cell wall portion 13 has channels 80 which extend between the upper plenum 28 and lower plenum 26 of the anolyte compartment 20. The anode 22 has channels 81 which extend between the top portion 24 and the bottom portion 25 of the anode. The channels 80 and 81 each partially define open passageways 82 which extend between the upper plenum 28 and lower plenum 26 of the anolyte compartment 20, thereby providing means for effecting communication between the two plenums. The passageways 82 are "open" passageways because they are only partially defined by channels 81 in the anode. The channels 80 in the cell wall 13 define other portions of the passageways 82 thereby giving the passageways rectangular cross-sections. The channels 81 are on the back surface 34 of the anode 22, spaced apart from the surface 40 exposed to the electrolysis zone 18. The passageways 82 are inside the cell boundary. These internal passageways 82 are important in industrial size electrolysis plants because of the savings in floor space of the cell. The passageways 82 are unexposed to and inaccessible from the middle portion 17 of the electrolysis zone 18, thereby preventing electrolyte which is carrying gas bubbles from entering into the passageways. The cathode 32 has similar channels 80 and 81' and similar open passageways 82'. It should be understood that the rectangular shape of the passageways 82 and 82' is not critical to this invention. Round or triangular passageways, for example, may be equally effective.

It can be seen from FIGS. 1 and 2 that passageways 82 have an enlarged cross-sectional area 85 nearest the upper plenum 28. This enlarged area permits a reduced velocity of electrolyte circulation near the upper plenum 28.

The total cross-sectional area of the two passageways 82 below the enlarged portion 85 is more than about 75% of the total cross-sectional area of the portion of the electrolysis zone 18 within the anolyte compartment 20. Preferably, the area of the two passageways 82 is about twice that of the electrolysis zone 18 within the anolyte compartment 20 to minimize friction and promote a rapid circulation of electrolyte. Large passageways 82 and the enlarged portion 85 reduce the downward velocity of electrolyte, especially near the upper plenum 28, and thereby give the product bubbles more time to burst without being sucked down into the passageway.

The channels 81 may be machined from the back surface 34 of the electrode 22. However, some materials, such as graphite, can easily be shaped into an electrode having the desired configuration. This latter method is preferable because of the savings in labor and material.

Figure 3:
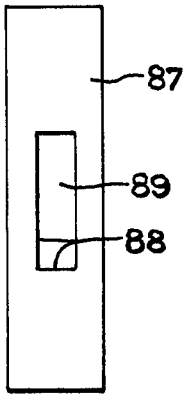
FIG. 3 is a top view of an alternative embodiment of an electrode of the present invention.

FIG. 3 is an alternative embodiment of an electrode of the present invention. Electrode 87 has channels 88 extending from a top portion of electrode 87 to a bottom portion. The channels 88 are entirely within the electrode and therefore define a "closed" passageway 89.

Figure 4:
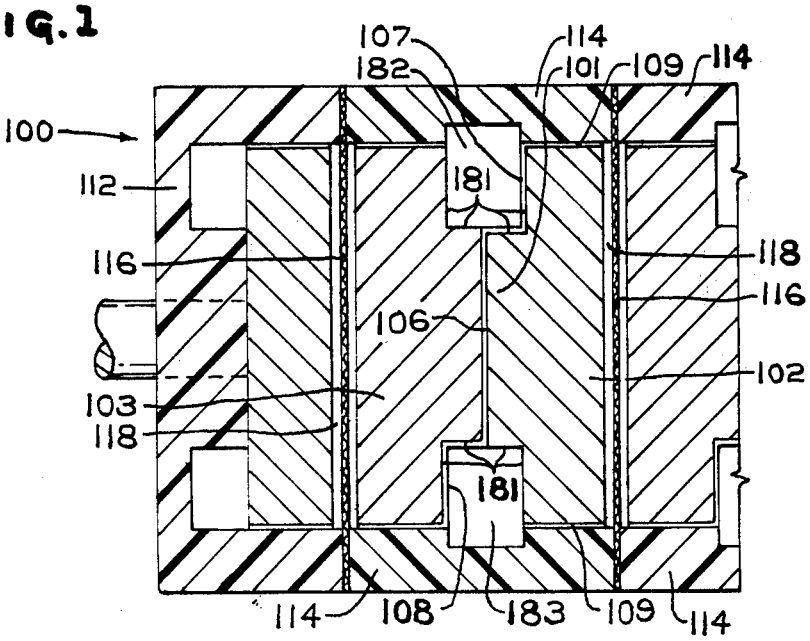
FIG. 4 is a top view of a portion of an alternative embodiment of an electrolytic cell of the present invention.

FIG. 4 is a top view of an electrolyzer 100 comprising a plurality of cells which are electrically connected in series. The cell 100 comprises an end cell wall portion 112 and intermediate cell wall portions 114. Bipolar electrode 101 has an anode portion 102 and a cahtode portion 103. A bipolar electrode such as 101 may be fabricated from a single piece of graphite, or may be divided at its center into two portions which are joined with an impervious but electrically conducting cement 106. The electrode 101 extends vertically to the top of the cell and is thereby adapted to separate the electrolytes. In graphite electrodes such as 101, the impervious cement will prevent intermingling of the anolyte and catholyte through the pores of the graphite.

Electrolyte separators 116 extend between opposing faces of the electrodes, thereby dividing each electrolysis zone 118 into an anolyte portion and a catholyte portion. Vertical channels 181 extend down the sides of electrode 101. The channels 181 partially define open passageways 182 and 183. Each passageway 182 and 183 is further defined by channels 180 in the intermediate cell wall 114. An upper portion (not shown) of the anode 102 can be cut away to provide a gas separation region for gas evolving from the anode and rising up through the anolyte portion of the electrolysis zone 118. The cut away portion of the anode further provides means of communication between the anolyte portion of the electrolysis zone and the anolyte passageway 183. The anolyte passageways 183 can thereby function to recirculate the anolyte. Similarly, cathode 103 is adapted to provide a gas separation region (not shown) for gas evolving from the cathode and to provide for communication between the catholyte portion of the electrolysis zone and catholyte passageway 182.

The portion of the cathode 103 which forms a boundary of the anolyte passageway 183 is coated with an impervious cement 108. The cement 108 prevents intermingling of anolyte in the passageway 183 with catholyte in the electrolysis zone 118. Similarly the channels 181 in the anode 102 which form a boundary of the catholyte passageway 182 are coated with an impervious cement 107. Impervious cement 109 prevents electrolyte permeation between the electrode 101 and the wall 114.

The passageways of the present invention, which may also be referred to as "downcomers," provide means for the electrolyte to flow to the bottom of a cell without opposing the product bubbles rising up through the electrolysis zone of the cell. The electrolyte at the top of the cell will take this route to the bottom of the cell because it is the path of least resistance. The bubbles will then be allowed to rise to the top of the cell unopposed by downflowing electrolyte.

As a further circulation drive force, the electrolyte in the passageways or downcomers creates a "gas lift effect". The downcomers are in communication with the bottom of the cell, causing the high density electrolyte in the downcomers to drive the lower density electrolyte containing the product bubbles upward through the electrolysis zone. Thus, the product bubbles are forced out of the electrolysis zone and into their collection zone at a much more rapid rate than in previously designed cells. This rapid internal electrolyte recirculation results in a substantially lower gas void density in the electrolysis zone and thus minimizes the electrolyte resistivity.

In operation of the cell 10 of FIGS. 1 and 2, as bubbles evolve in the electrolysis zone 18, they rise up through the electrolyte to the collection zone. When they reach the top level 70 of the electrolyte, they must emerge from the electrolyte in order to burst, thus allowing the electrolyte boundary layer to fall back into the electrolyte. Some difficulty may be encountered in bursting the bubbles after they reach the collection zone. If the bubbles merely float on the top of the electrolyte level 70, they may be sucked down into the passageway 82 by the circulating electrolyte. Eventually they will rise up through the passageway, opposing the flow of electrolyte and slowing the circulation. It has been found this problem can be avoided by raising the electrolyte level 70 sufficiently above the electrode 22. This allows the bubbles to float on the surface of the electrolyte without being sucked into the passageway. The enlarged cross-sectional areas 85 of the passageways 82 will also aid in this regard. They act to reduce the circulation rate near the upper plenum thereby giving the bubbles more time to free themselves of their boundary layer of electrolyte and to burst into the collection zone.

Although the foregoing structure has been described in a diaphragm type cell for the purpose of illustrating a presently preferred embodiment of the invention, it should be understood that many modifications or alterations may be made without departing from the spirit and the scope of the invention as set forth in the appended claims.

I claim:

1. In an electrolytic cell comprising:

a. a cell wall portion at least partially defining boundary of said cell;

b. a first vertically extending electrode having a top portion and a bottom portion on a vertically extending surface;

c. a second vertically extending electrode, adjacent said first electrode and having a vertically extending surface opposing said vertically extending surface of said first electrode; and d. an electrolysis zone between said first and second electrodes, said electrolysis zone having an upper portion, a lower portion and a middle portion intermediate said upper and lower portions and defined by the opposing surfaces of said electrodes;

e. an upper electrolyte plenum chamber adjacent said top portion of said first electrode; and f. a lower electrolyte plenum chamber adjacent said bottom portion of said first electrode; the improvement wherein at least one of said first and second electrodes includes at least one vertically extending channel-like portion which at least partially defines a recirculation passageway extending between said upper and lower electrolyte plenums of said cell, said channel-like portion of said electrode spaced from said vertically extending surface such that no fluid communication between said channel-like portion and said surface is possible.

2. An improvement as defined in claim 1 wherein said channel is in said electrode.

3. An improvement as defined in claim 1 wherein said channel is in said cell wall portion.

4. An improvement as defined in claim 1 wherein said passageway comprises an enlarged cross-sectional area adjacent said upper plenum.

5. An improvement as defined in claim 1 wherein said electrolytic cell further comprises an electrolyte, wherein the top portion of said first electrode is below the level of said electrolyte.

6. An improvement as defined in claim 1 wherein said cell comprises a plurality of channels in said first electrode which at least partially define a plurality of passageways, said passageways extending between said upper and lower electrolyte plenums, each of said plurality of passageways disposed to be inaccessible from said middle portion of said electrolysis zone, wherein the total cross-sectional area of said plurality of passageways is approximately equal to the cross-sectional area of said electrolysis zone.

7. An electrode adapted to be positioned vertically in an electrolytic cell, said electrode comprising;

a. a top portion and a bottom portion;

b. a surface for exposure to an electrolysis zone;

c. a channel extending between said top portion and said bottom portion, said channel at least partially defining a passageway wherein said channel is disposed in a portion of the electrode other than said surface for exposure to an electrolysis zone and is noncommunicative with said surface.

8. An electrode as described in claim 7 wherein said electrode is a bipolar electrode.

9. An electrode as defined in claim 7 wherein said channel is disposed entirely within said electrode.

10. An electrode as defined in claim 7 wherein said channel is disposed on another surface of said electrode.

11. An improvement as defined in claim 1 further comprising a vertically extending electrolyte separator at least partially within said electrolysis zone between said first and said second electrodes.

12. An improvement as defined in claim 1 further comprising means for electrolytically evolving a gas at a surface of at least one of said electrodes, said surface extending adjacent said electrolysis zone, wherein said gas is adapted to evolve into said electrolysis zone.

* * * * *